US006322177B1

(12) United States Patent
Vasudeva

(10) Patent No.: US 6,322,177 B1
(45) Date of Patent: Nov. 27, 2001

(54) DROP-BIN CONTAINERS AND HOLDERS FOR SAME

(75) Inventor: Kailash C. Vasudeva, Waterloo (CA)

(73) Assignee: Maxtech Manufacturing Inc., Waterloo (CA)

( * ) Notice: Subject to any disclaimer, the term of this patent is extended or adjusted under 35 U.S.C. 154(b) by 0 days.

(21) Appl. No.: 09/422,964

(22) Filed: Oct. 22, 1999

(51) Int. Cl.[7] ..... A47B 67/02

(52) U.S. Cl. ..... 312/242; 312/305; 312/216; 206/373

(58) Field of Search ..... 206/372–379, 206/503–505; 312/325, 326, 327, 272, 276, 328, 242, 305, 293.1, 216

(56) References Cited

U.S. PATENT DOCUMENTS

| | | | | |
|---|---|---|---|---|
| 4,616,891 | * | 10/1986 | Jantzen | 312/276 |
| 4,815,795 | * | 3/1989 | Accumanno et al. | 312/242 |
| 5,114,007 | | 5/1992 | Chen . | |
| 5,458,409 | * | 10/1995 | Sheng | 312/328 |
| 5,570,784 | | 11/1996 | Sidabras et al. . | |
| 5,758,769 | | 6/1998 | Vasudeva . | |
| 5,803,254 | | 9/1998 | Vasudeva . | |
| 5,887,715 | * | 3/1999 | Vasudeva | 312/902 |

FOREIGN PATENT DOCUMENTS

| | | |
|---|---|---|
| U 8813391.5 | 3/1989 | (DE) . |
| 0 296 303 | 12/1988 | (EP) . |

* cited by examiner

*Primary Examiner*—Peter M. Cuomo
*Assistant Examiner*—Jerry A. Anderson
(74) *Attorney, Agent, or Firm*—R. Craig Armstrong

(57) ABSTRACT

The drop-bin unit has at least several bins arranged to pivot outwardly about a generally horizontal axis, from a closed position where outer faces of the bins are generally aligned vertically with each other, to an open position where the outer surfaces angle outwardly from their closed positions. The bins are stacked one above another within a housing, and are connected together, for example via at least one gang bar, such that pivoting one bin outwardly causes all of the bins to pivot outwardly in unison. The units may be sold separately, for use as stand-alone containers, or may be sold to be placed in a holder which holds one or preferably a number of the units. The holder can be sold with one or more of the units, or may be sold as a completely separate item. The holder can take a variety of forms. The units on their own or in holders provide flexibility for carrying job-specific items, avoiding the need to carry an entire toolbox to a particular job.

3 Claims, 17 Drawing Sheets

DROP-BIN CONTAINERS AND HOLDERS FOR SAME

BACKGROUND OF THE INVENTION

This invention relates to compartmentalized containers for small objects, particularly intended for small hardware items and tool components, but useful for a wide variety of purposes. Other uses could include, for example, cosmetic kits, fishing tackle, organizers for medication, storage for pens, pencils, crayons, storage for various condiments in the kitchen, organizers for women's trinkets, hobby kits, recreational items, sewing kits, etc.

Although many small containers exist, of course, there is always a need for new and improved containers which are easy and convenient to market and to use, and which can be easily carried around by a person, if desired (either one at a time, or several at a time).

SUMMARY OF THE INVENTION

In the invention, a "drop-bin" unit is provided, i.e. a unit having at least several bins arranged to pivot outwardly about a generally horizontal axis, from a closed position where outer faces of the bins are generally aligned vertically with each other, to an open position where the outer surfaces angle outwardly from their closed positions. The bins are stacked one above another within a housing, and are connected together, for example via at least one gang bar, such that pivoting one bin outwardly causes all of the bins to pivot outwardly in unison.

The units may be sold separately, for use as stand-alone containers, or may be sold to be placed in a holder which holds one or preferably a number of the units. The holder can be sold with one or more of the units, or may be sold as a completely separate item. The holder can take a variety of forms, as described in detail below.

The units on their own or in holders provide great flexibility for carrying job-specific items, e.g. seals and washers for plumbing jobs, Marrette™ connectors, assorted terminals, etc. for electrical jobs, and so on. Using a holder which can carry a number of drop-bin units allows the user to remove and replace units as desired, thus avoiding the need to carry an entire toolbox to a particular job.

Further features of the invention will be described or will become apparent in the detailed description which follows.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE INVENTION

Figure 1:
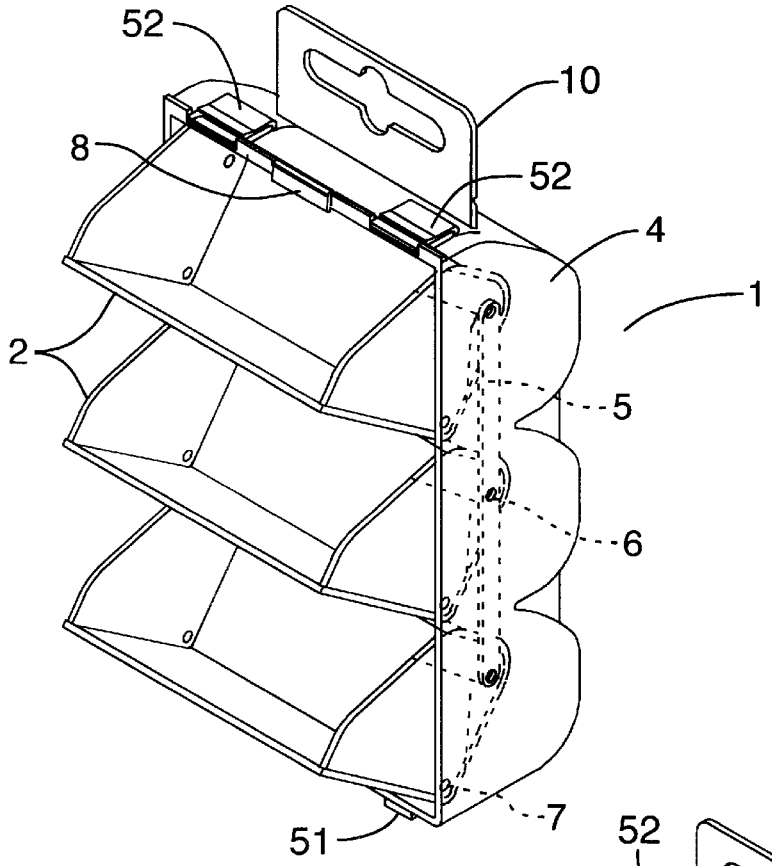
FIG. 1 is a perspective view of the preferred embodiment of the drop-bin unit, with the bins open.
Figure 2:
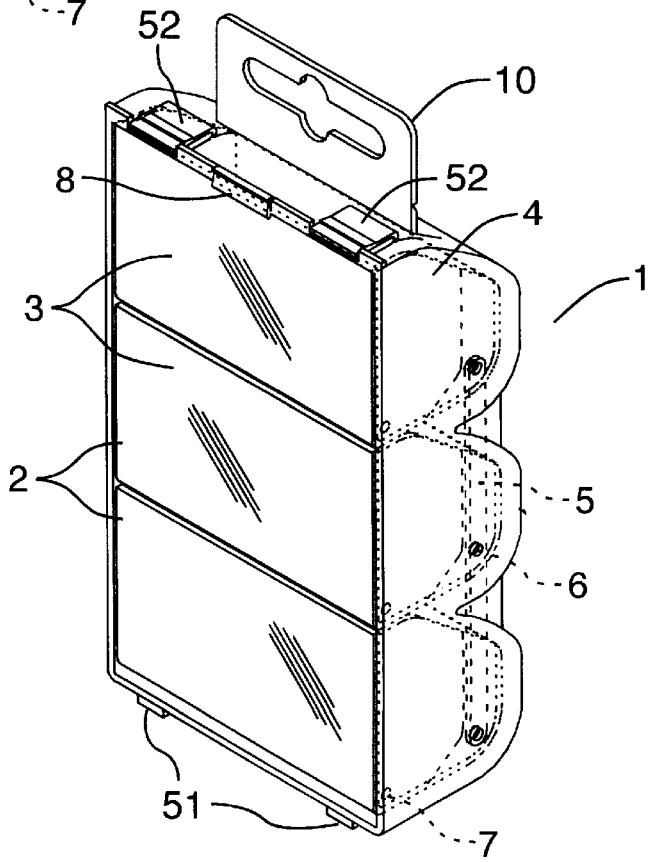
FIG. 2 is a corresponding view with the bins closed.

The preferred embodiment of the "drop-bin" unit 1, seen most clearly in FIGS. 1 and 2, can be sold and used on its own, or can be sold on its own intended to be used as part of a larger system, or sold together with a larger system. The unit has several bins 2 arranged to pivot outwardly about a generally horizontal axis. FIG. 1 shows the bins pivoted outwardly to an open position, and FIG. 2 shows the bins in their closed position where outer faces 3 of the bins are generally aligned vertically with each other.

Figure 14:
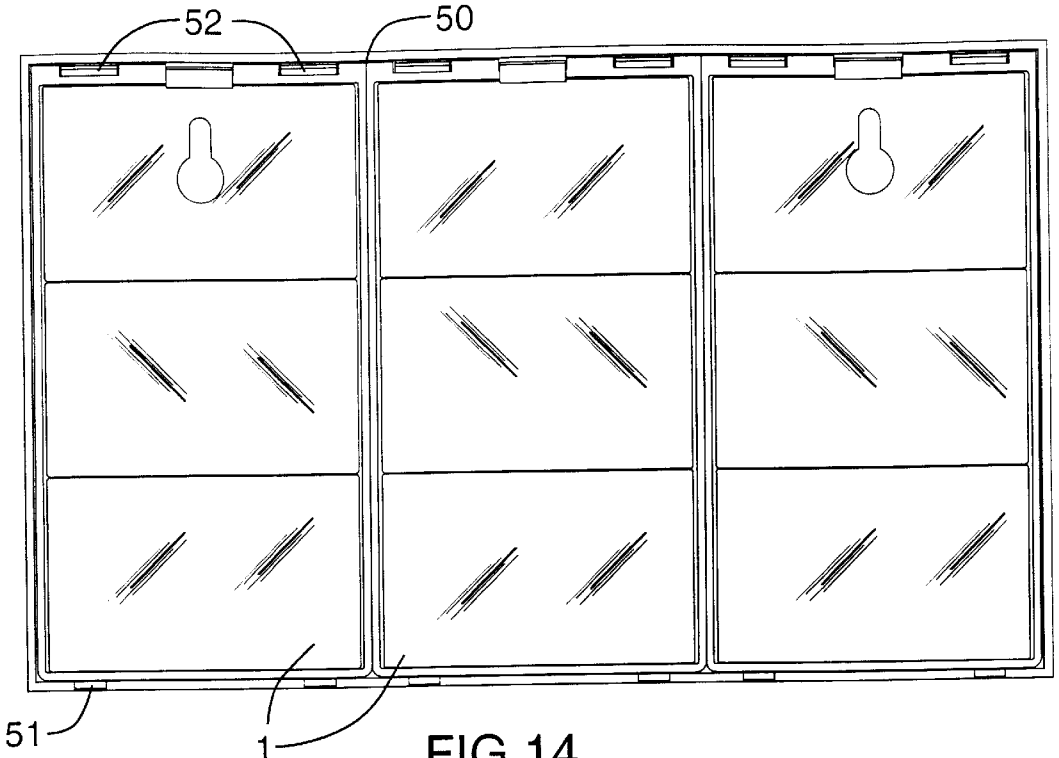
FIG. 14 is a front view showing a holder with three units mounted therein.
Figure 33:
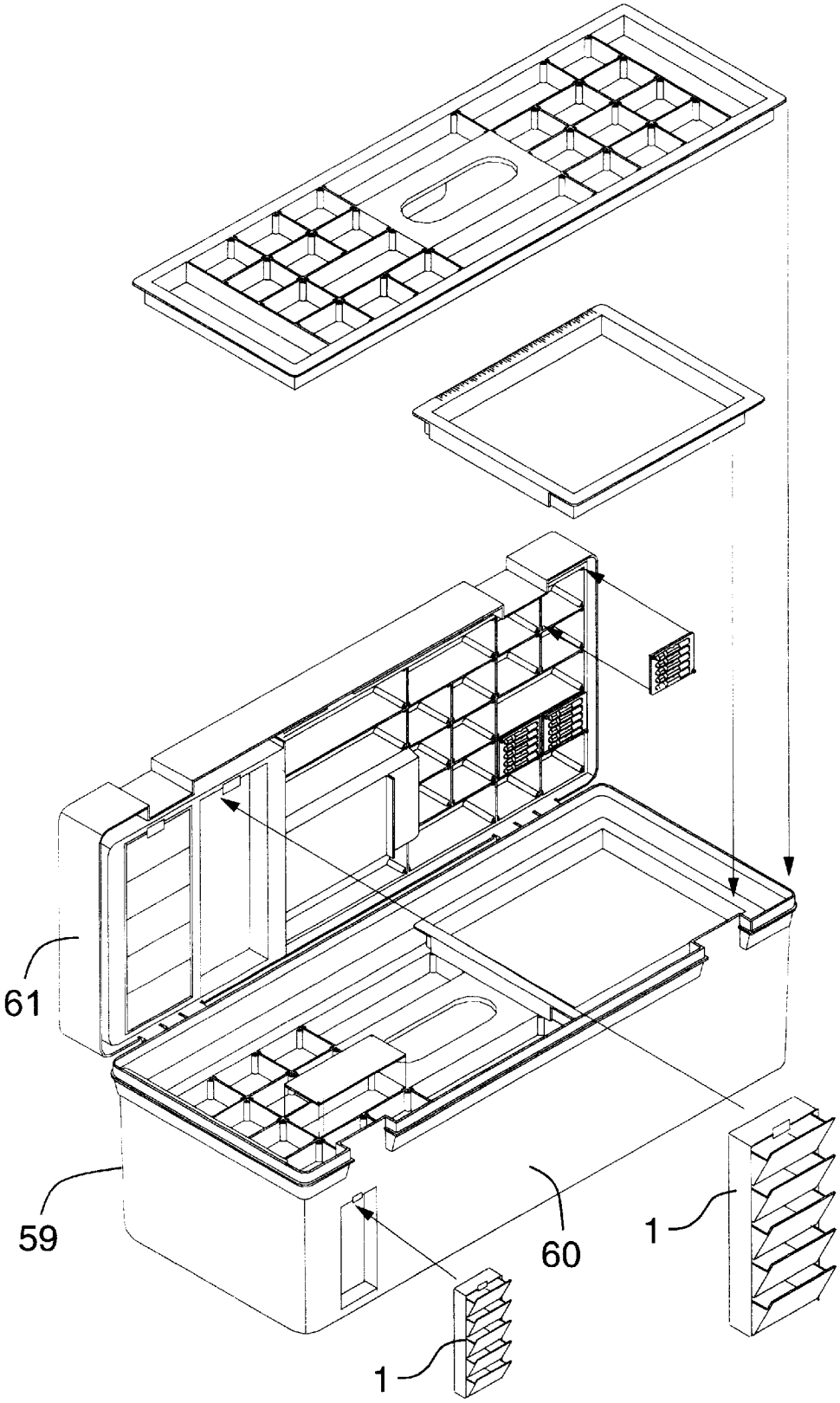
FIG. 33 is an exploded perspective view showing the units mountable in a tool box

The larger system could be, for example, a holder which is configured to receive one or many such drop-bins. The holder could be, for example, a holder 50 as shown in FIG. 14. This and other holders are described in detail below, as specific examples only. Alternatively, the holder could be a tool box 59, as shown in FIG. 33, i.e. one or more units could be fitted into recesses in the outside 60 of a tool box or could be snapped below the lid 61 of the tool box.

More will be said about various holder options later, but first the preferred embodiment of the drop bin unit will be described in detail.

Within each drop-bin unit 1, the bins 2 are stacked one above another within a housing 4, and are connected together, for example via at least one gang bar 5 connecting the bins to each other, such that pivoting one bin outwardly causes all of the ganged bins to pivot outwardly in unison. There could be one gang bar only, or one gang bar along each side of the bins. Alternatively, the bins could be connected in the manner shown in FIGS. 34 and 35, described in greater detail below, or in any other suitable fashion.

Each gang bar is connected to the bins by protruding pins 6 located along its length which fit into holes in the side walls of each bin. Alternatively, it should be clear that the pins could protrude from the side walls of each bin, to fit into holes in the gang bar. The bins pivot in the housing via pins 7 on either side of the bins. Obviously, these could be pins extending from the bins into holes or depressions in the housing, or vice versa.

Figure 3:
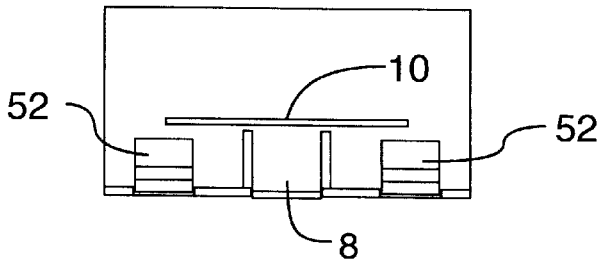
FIG. 3 is a top view of the unit.
Figure 4:
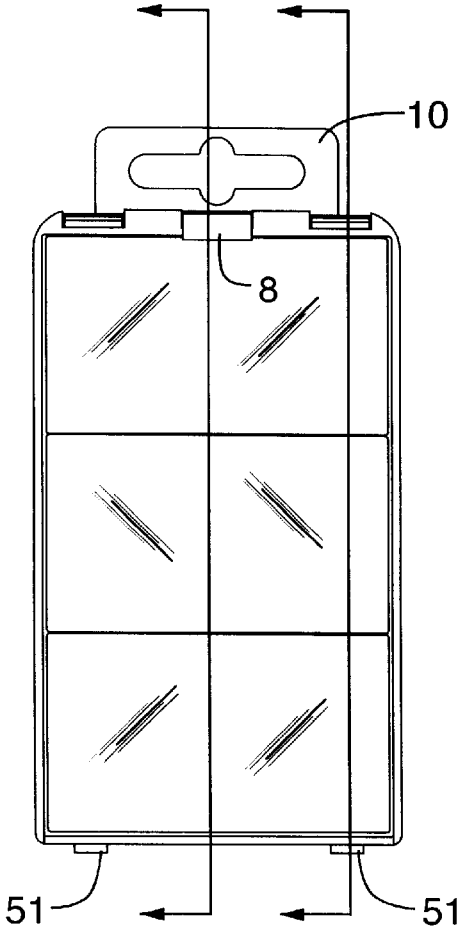
FIG. 4 is a front view of the unit.
Figure 5:
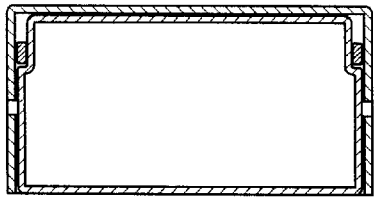
FIG. 5 is a top cross-sectional view of the unit.
Figure 6:
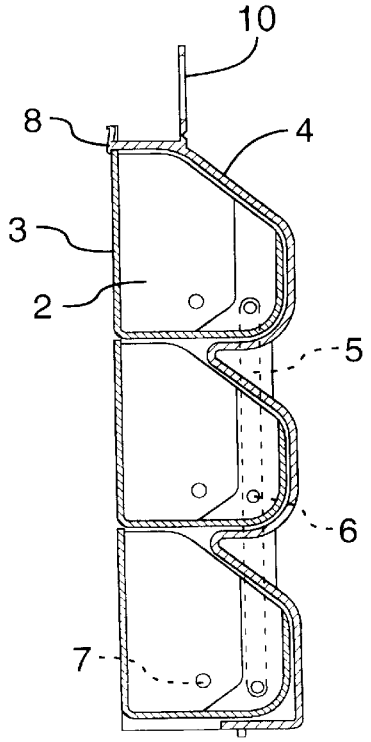
FIG. 6 is a side cross-sectional view of the unit, with the bins closed.
Figure 7:
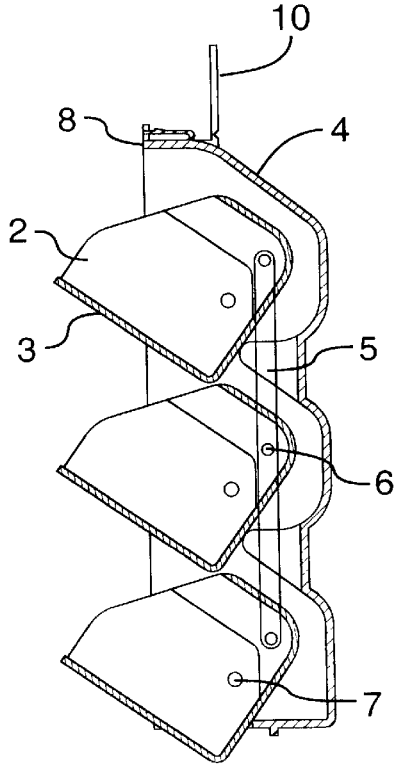
FIG. 7 is a side cross-sectional view of the unit, with the bins open.
Figure 8:
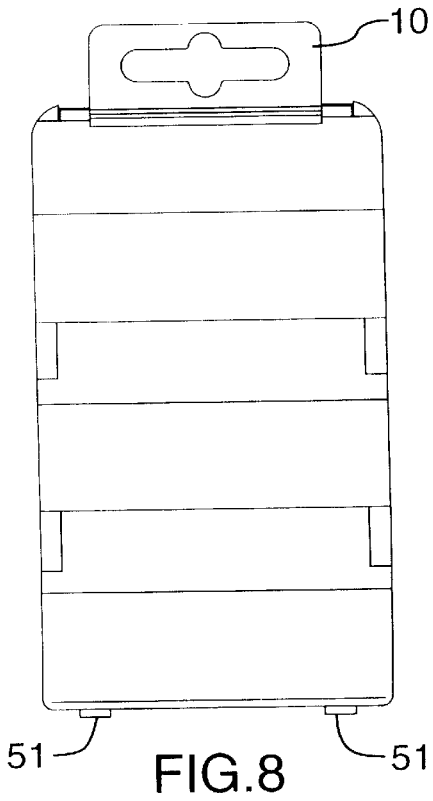
FIG. 8 is a rear view of the unit.
Figure 9:
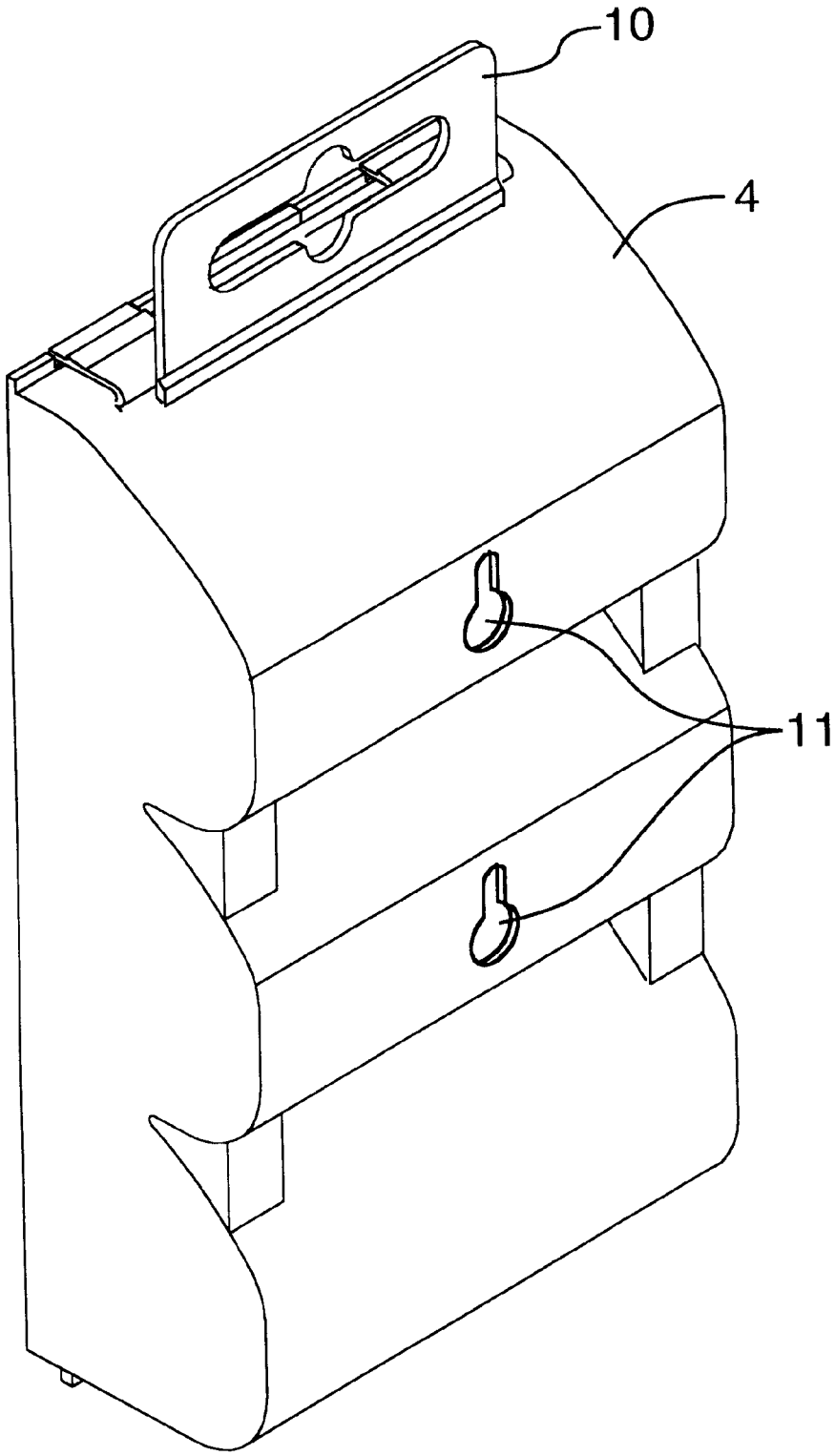
FIG. 9 is a perspective view of the rear of the unit.

The bins are kept in their closed position by a flexible plastic tab 8 at the top of the housing, the tab having a lip extending just slightly downwardly to catch the uppermost bin. The tab could be configured as shown in FIGS. 1 and 2, or with slots on either side thereof as in FIG. 3, for cantilevering to promote flexibility. Any other suitable means of securing the bins to the housing could be used. To open the bins, pulling slightly on one of them is enough to disengage the tab 8, to allow the bins to rotate. Alternatively, in some embodiments, in could be made necessary that the tab must be manually dislodged in order for the bins to be openable. Closing the bins causes the lip to catch the uppermost bin slightly, so that they remain closed until pulled outwardly again.

The entire unit preferably is molded plastic, but the entire assembly and/or one or more of the bins could be of metal or other suitable material, to permit other uses. For example, the unit to be used as a combination ashtray/coin holder.

Figure 13:
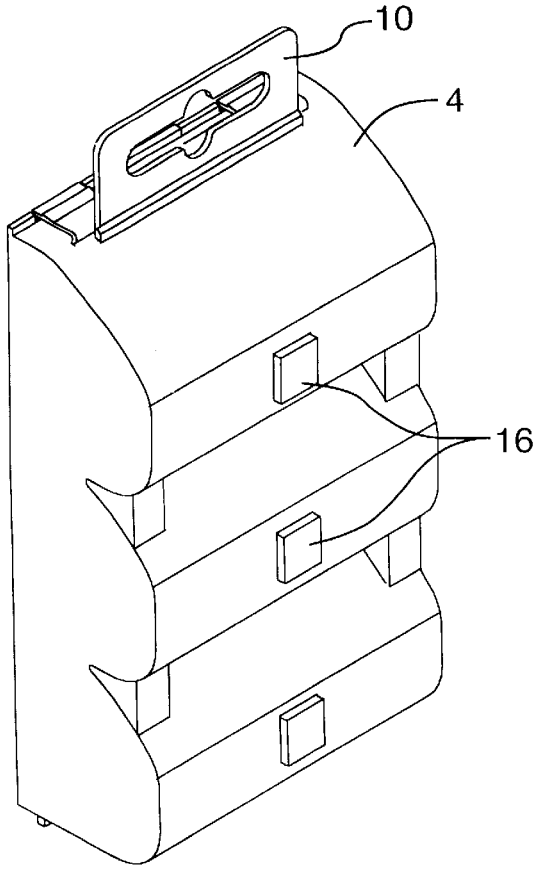
FIG. 13 is a perspective view showing the unit with the magnets.

Preferably, each drop-bin unit is fitted with a "butterfly" 10, with a hole for hanging on a peg hook at the point of sale or in the purchaser's workshop. The butterfly can be fixed, but preferably has a living hinge where it joins the body of the housing, so that it can be folded flat, as shown in FIG. 13, if the unit is to be snapped into a holder. Alternatively, it can be frangible, so that it can be broken off by the purchaser if desired.

Preferably, each unit can also have keyhole opening 11 on a rear surface, for hanging the unit on a nail, screw, etc.

Figure 10:
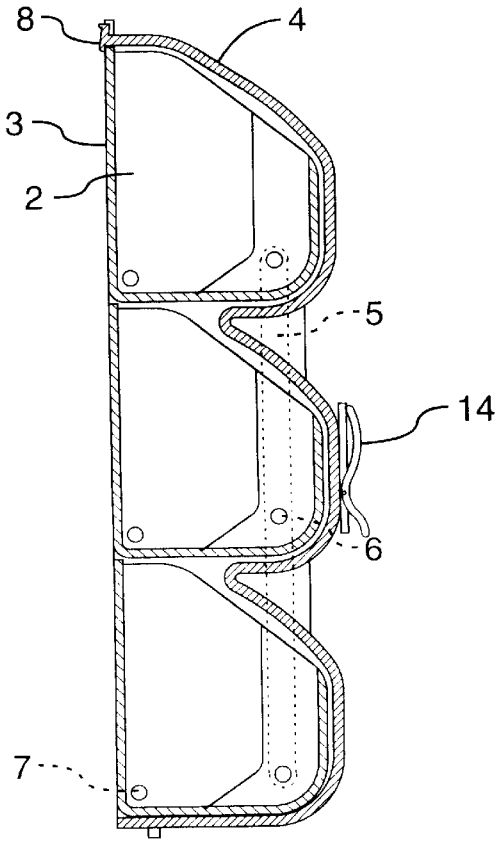
FIG. 10 is a side cross-sectional view showing a clip on the rear of the unit.
Figure 11:
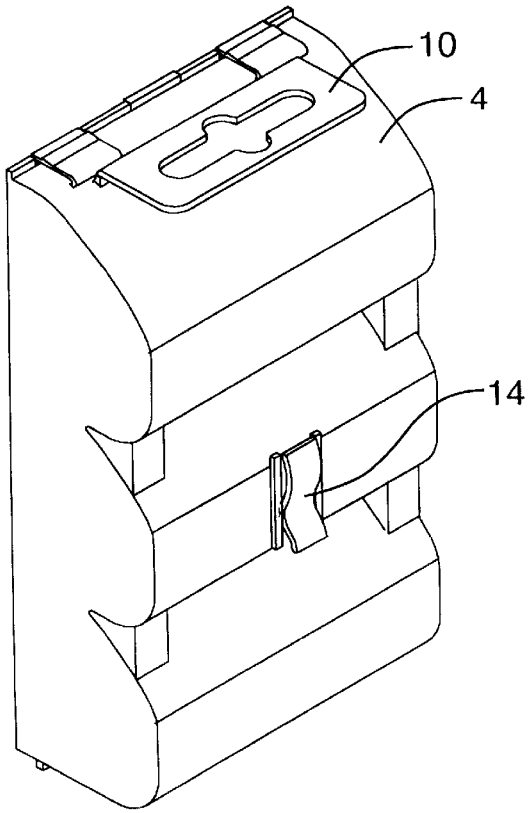
FIG. 11 is a perspective view showing the unit with the clip.

Optionally, as shown in FIGS. 10 and 11, each unit can be provided with a molded/detachable clip 14 that can enable clipping on a rail (individually or side-by-side) or carrying on a belt or in a pocket.

Figure 12:
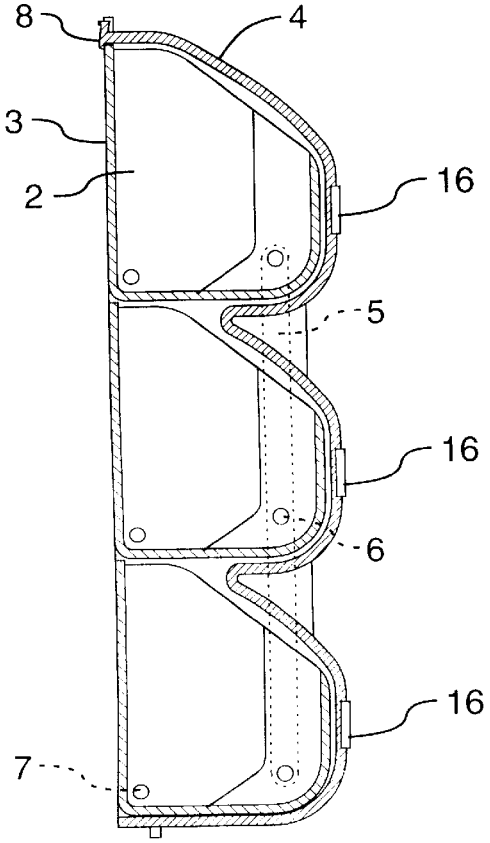
FIG. 12 is a side cross-sectional view showing magnets on the rear of the unit.

Alternatively, as shown in FIGS. 12 and 13, the units can be fitted with one or more adhesive-backed magnets 16 to facilitate mounting on any metal surface, i.e. the side of a metal tool box, refrigerator, etc.

Similarly, the units could have a Velcro™ hook or pile strip (not shown) that would allow it to be secured to a counterpart strip on another object, for example the sun visor in an automobile.

Larger systems can be assembled by fitting individual drop-bin units together, either back-to-back or side-by-side, using a variety of means, i.e. pins and holes, slots, tongue-and-groove, etc.. Alternatively, larger systems can be assembled by snapping one or more units into various holders, as mentioned previously. Various holder options will now be described in greater detail.

Figure 15:
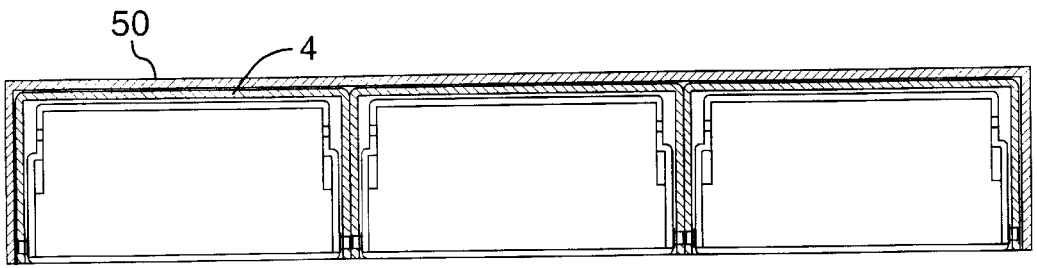
FIG. 15 is a top cross-sectional view showing the holder and units of FIG. 14.
Figure 16:
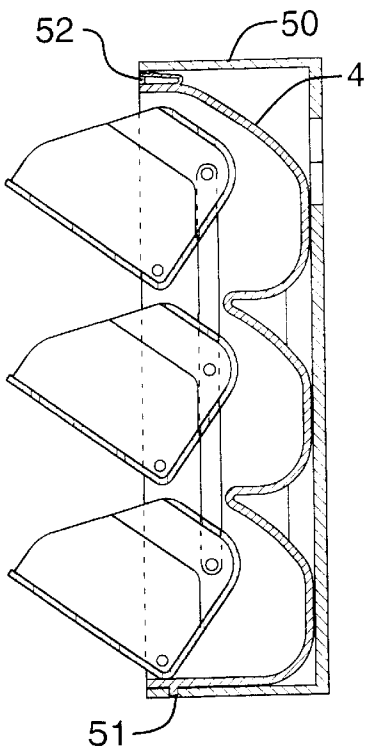
FIG. 16 is a side cross-sectional view showing the holder and units of FIG. 14, with the bins open.

As shown in FIGS. 14–16, for example, a separate holder 50 can be provided that will enable drop-bins to be snapped in. As seen in FIGS. 1 and 2, the units preferably have two tabs 51 at the bottom thereof, to insert into corresponding slots in the holder 50. The units also preferably have two springy catches 52 at the top thereof, with a lip portion which projects slightly upwardly, such that when the tabs 51 are inserted, and the unit is then rotated into the holder, the catches 52 cause the lip portions to snap into corresponding slots in the top of the holder. The units can be removed by depressing the catch slightly to disengage the lip portions from the slots.

FIGS. 14–16 show a holder with three units mounted therein. Obviously, however, there could be only one unit, if desired, or many.

Figure 17:
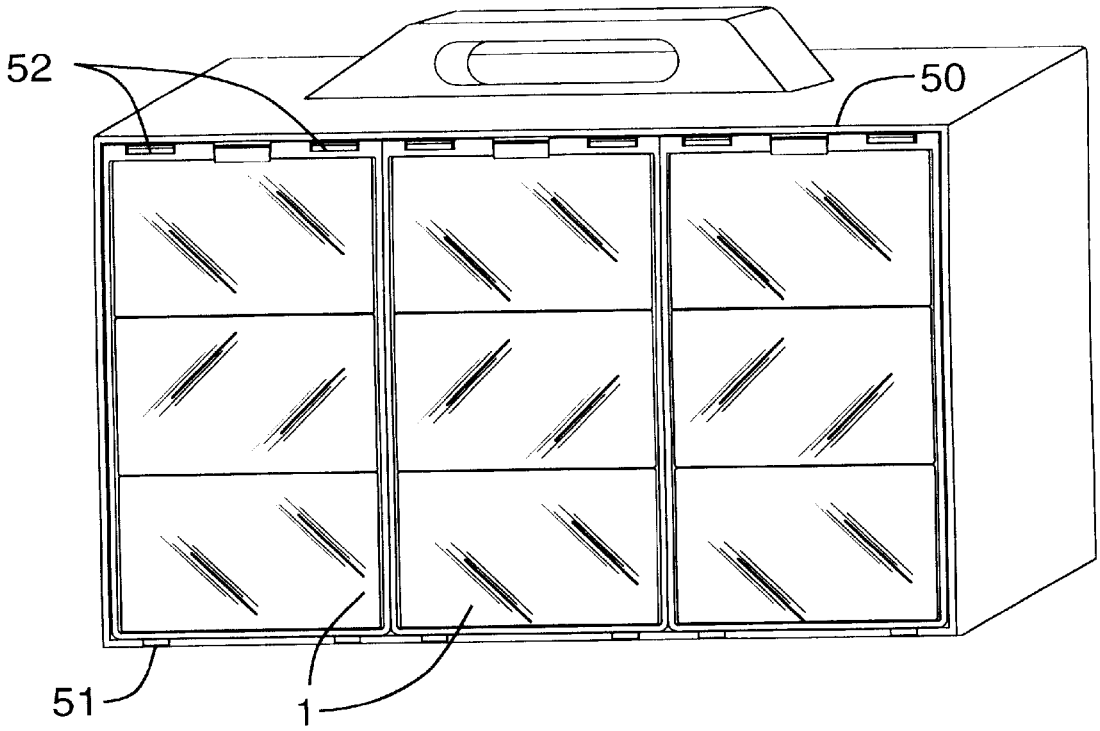
FIG. 17 is a perspective view showing a similar holder to that of FIGS. 14–16, but with a carrying handle.
Figure 19:
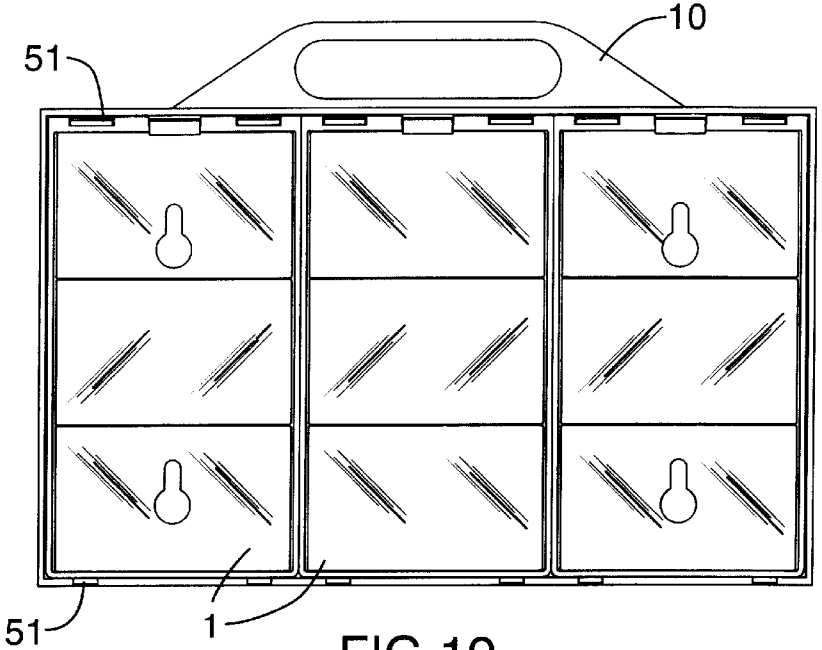
FIG. 19 is a front view showing the holders of FIG. 18.

As illustrated in various drawings, the holder can be fabricated with a handle for carrying (e.g. FIG. 17), and/or keyhole openings at the rear for wall mounting (FIG. 19).

Figure 20A:
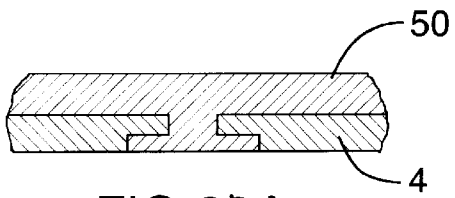
FIG. 20A is a close-up cross-sectional view showing the connection between the FIG. 18 holders.
Figure 18:
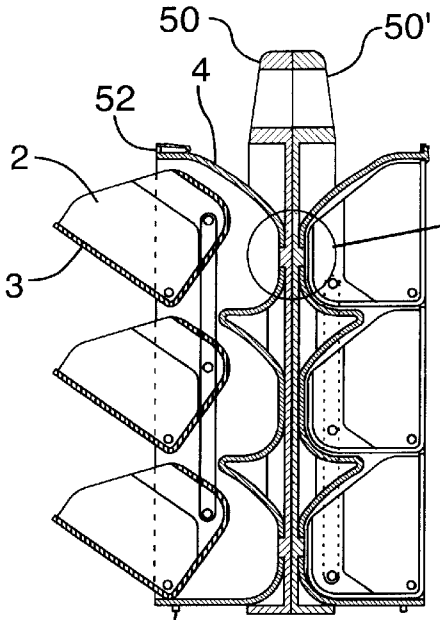
FIG. 18 is a side cross-sectional view showing two holders, mated with each other back-to-back.
Figure 18A:
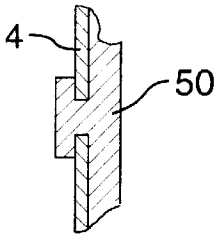
FIG. 18A is a close-up cross-sectional view showing the connection between a housing of one of the units, and one of the FIG. 18 holders.
Figure 20:
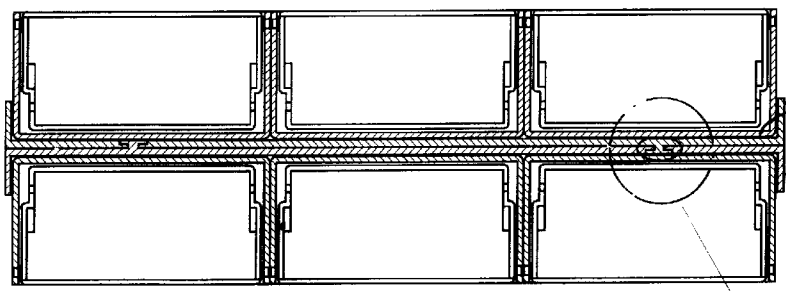
FIG. 20 is a top cross-sectional view of the FIG. 18 holder.

FIG. 18 is an example showing two holders 50 and 50', mated with each other back-to-back. FIG. 18A shows one example of how the housings 4 can be connected to the holder 50. FIG. 19 is a front view showing the holders of FIG. 18. FIG. 20 is a top cross-sectional view. FIG. 20A is a close-up cross-sectional view again showing one example of how the housings 4 can be connected to the holder 50.

Figure 22:
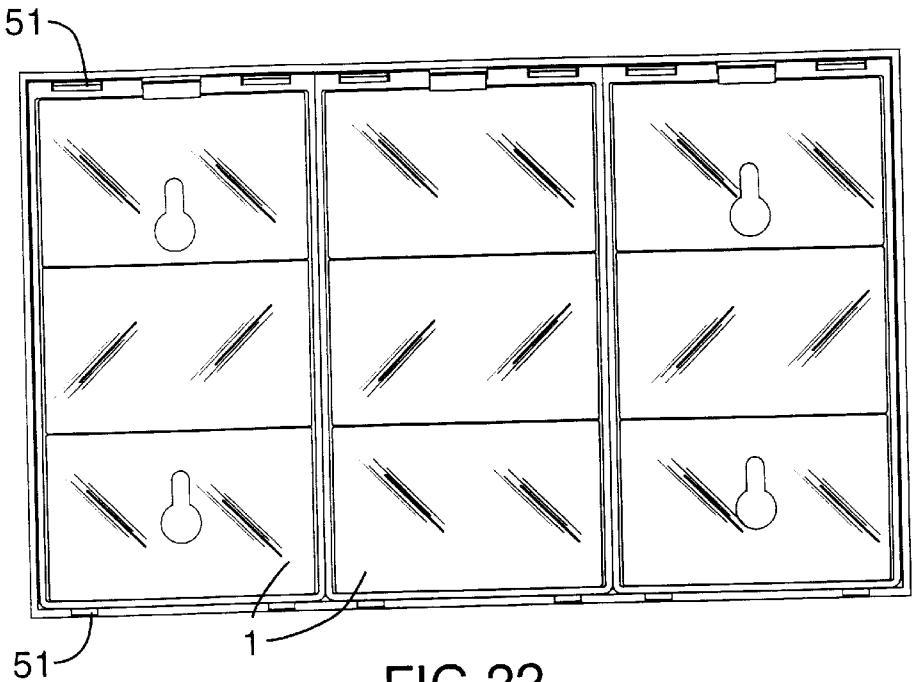
FIG. 22 is a front view showing the holder of FIG. 21.
Figure 23:
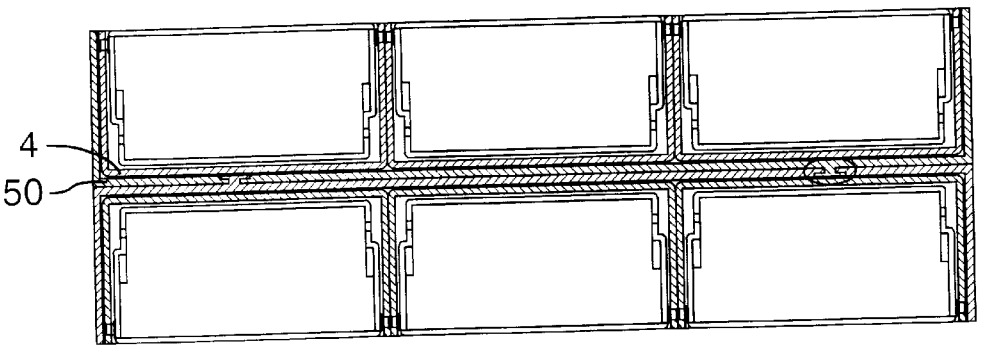
FIG. 23 is a top cross-sectional view showing the FIG. 21 holder.
Figure 21:
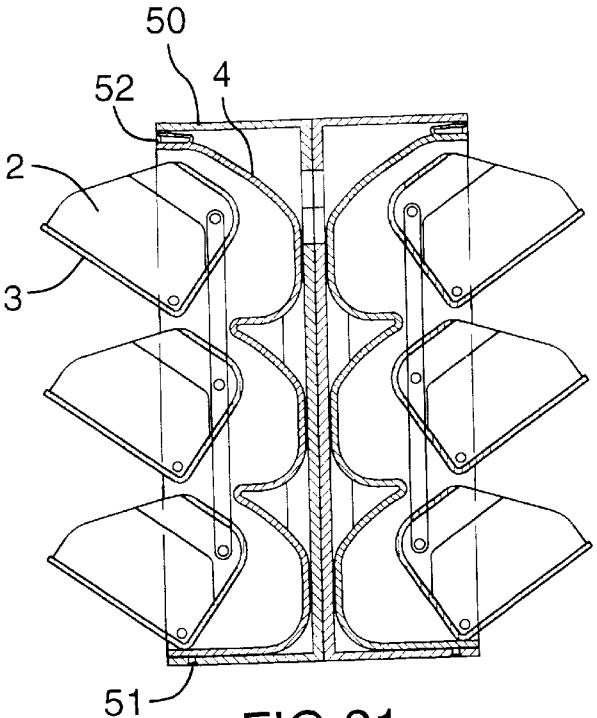
FIG. 21 is a side cross-sectional view of a holder similar to that of FIG. 18, but fully covering the sides of the units.

FIG. 21 is a side cross-sectional view showing another alternative with two holders 50 and 50', similar to that of FIG. 18 but fully covering the top, bottom and sides of the units. FIG. 22 is a front view showing the holder of FIG. 21, and FIG. 23 is a top cross-sectional view.

Figure 24:
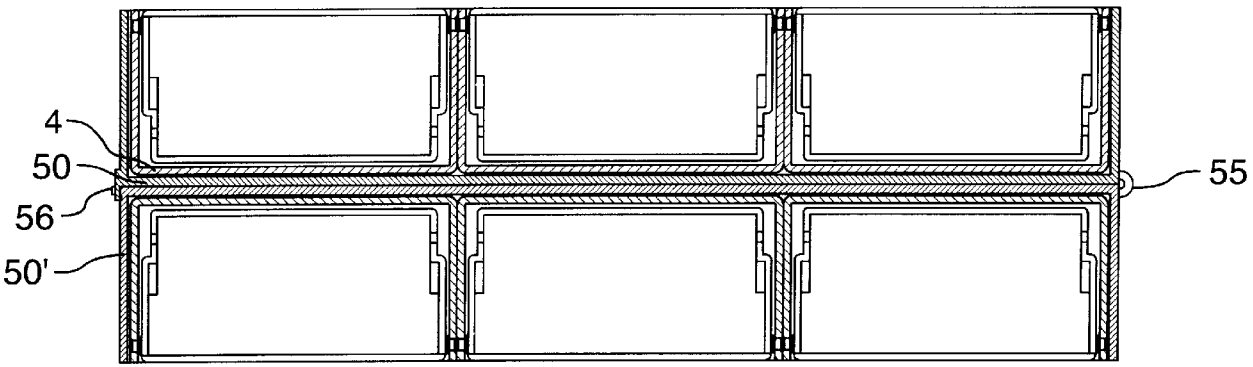
FIG. 24 is a top cross-sectional view showing a holder which has two section which are hinged to each other, shown folded shut.
Figure 25:
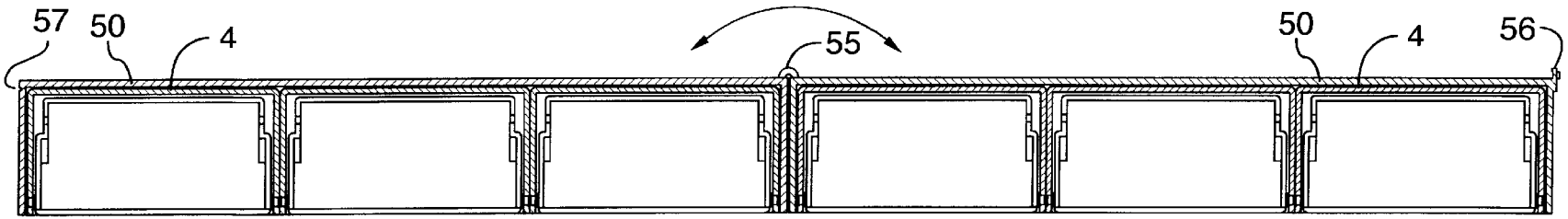
FIG. 25 is a top cross-sectional view showing the FIG. 24 holder, folded open.

FIG. 24 is a top cross-sectional view showing a holder which has two sections 50 and 50' which are hinged to each other by a hinge 55, shown folded shut. A small catch 56 engages a small notch 57 to hold the section together, or any other suitable catch or closure means could be used. FIG. 25 shows the FIG. 24 holder, folded open.

Figure 26:
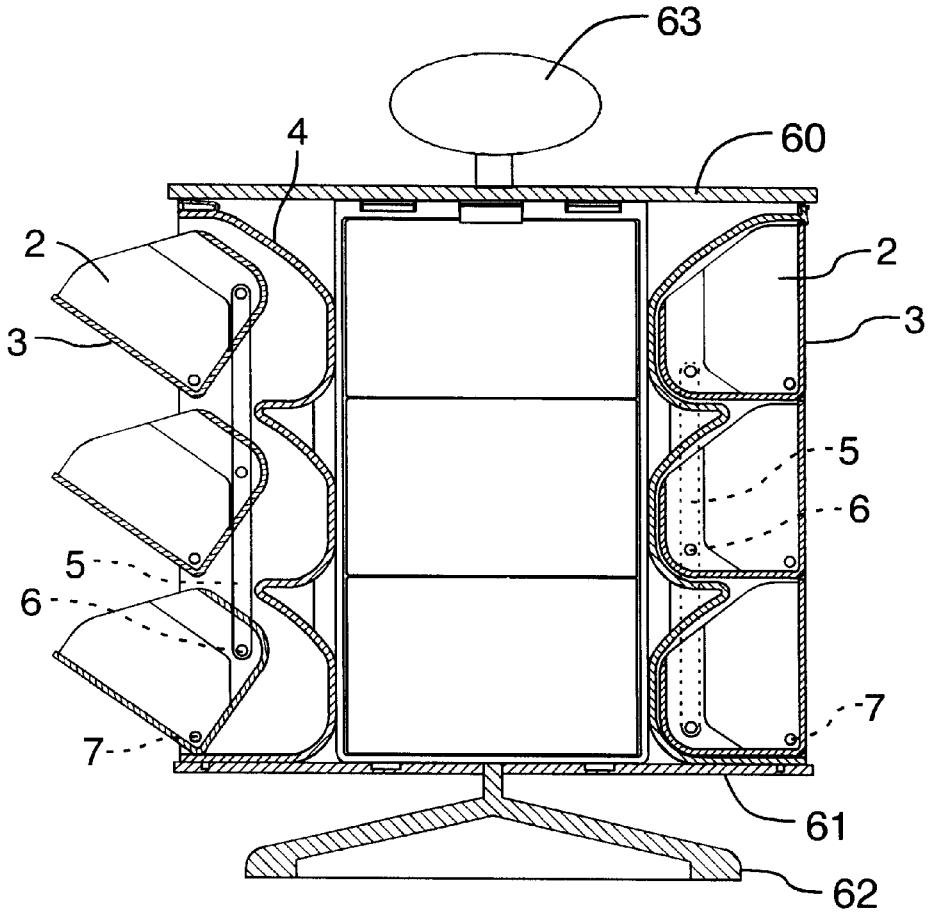
FIG. 26 is a front cross-sectional view showing a carousel arrangement of several units.
Figure 27:
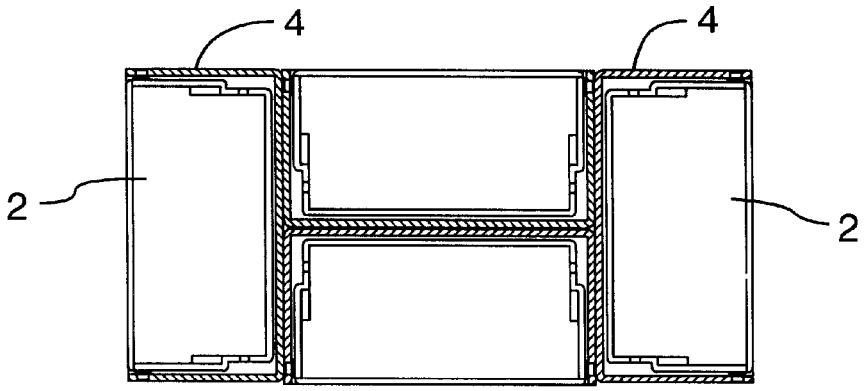
FIG. 27 is a top cross-sectional view of the FIG. 26 holder.

FIG. 26 is a front cross-sectional view showing a carousel arrangement of several units. The bins snap between top and bottom plates 60 and 61 respectively, mounted on a base 62. A handle 63 is provided, for carrying or rotating the assembly. FIG. 27 is a top cross-sectional view of the FIG. 26 holder.

Figure 28:
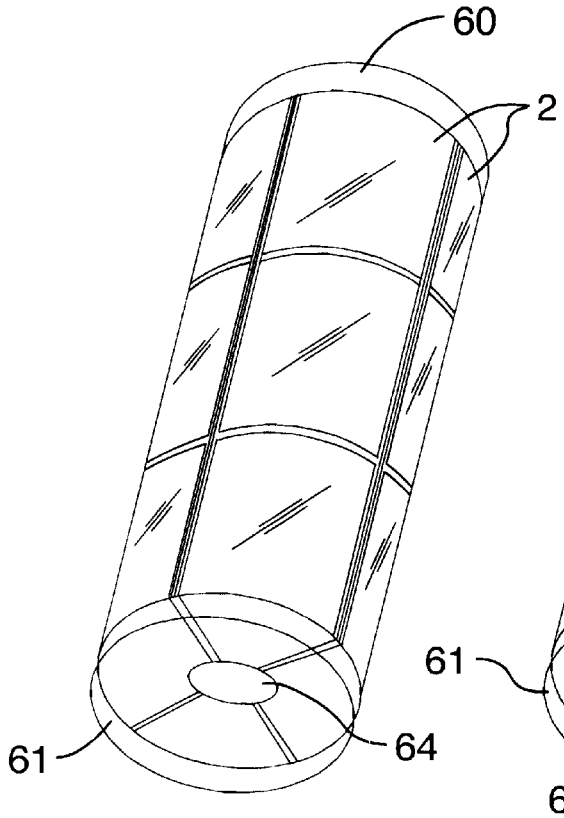
FIG. 28 is a perspective view showing a cylindrical version.
Figure 29:
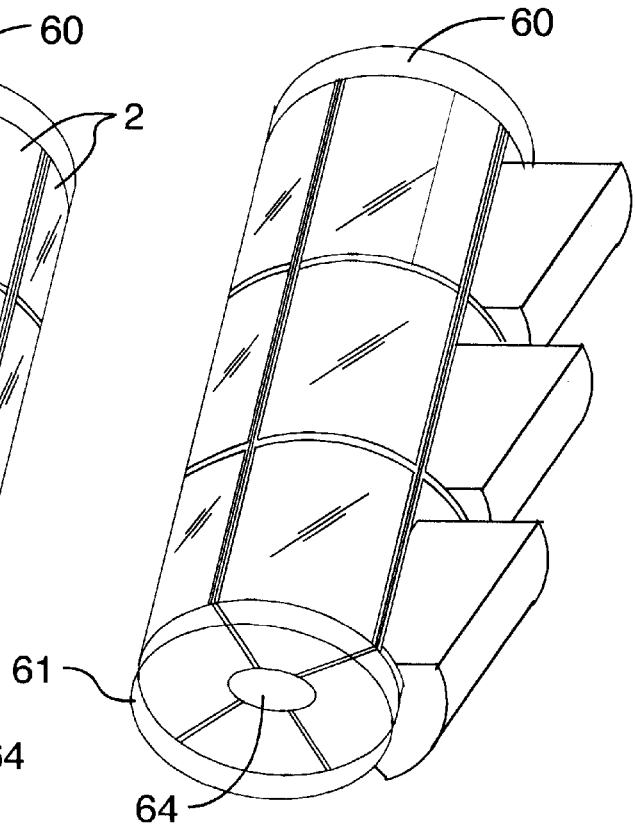
FIG. 29 is a perspective view showing the FIG. 28 version with the bins open.
Figure 30:
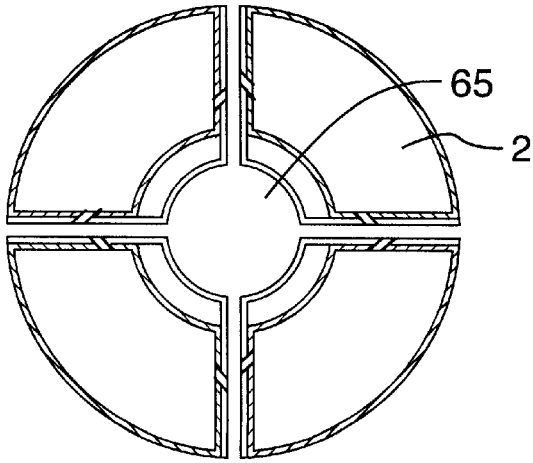
FIG. 30 is a top cross-sectional view of the FIG. 28 version.

FIG. 28 is a perspective view showing a cylindrical version, where wedge-shaped bins are mounted between upper and lower plates 60 and 61 around a central post assembly 64. FIG. 29 is a perspective view showing the FIG. 28 version with the bins open. FIG. 30 is a top cross-sectional view of the FIG. 28 version.

Figure 31:
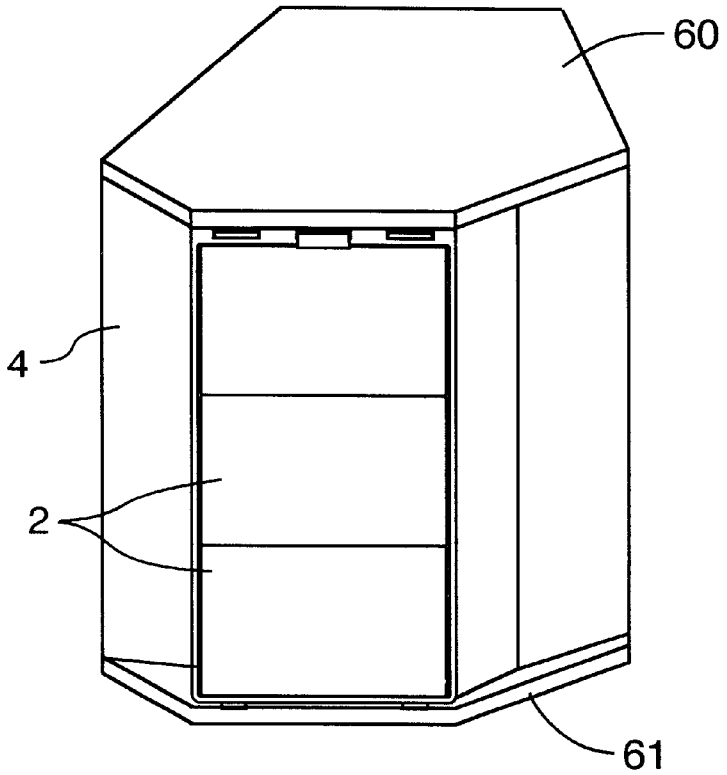
FIG. 31 is a perspective view showing a holder with three units arranged in a triangular fashion.
Figure 32:
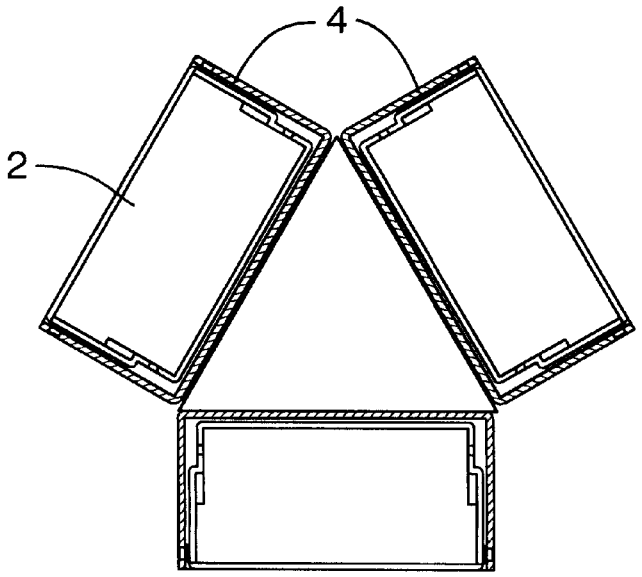
FIG. 32 is a top cross-sectional view showing the FIG. 31 holder.

FIG. 31 is a perspective view showing a holder with three units arranged in a triangular fashion between top and bottom plates 60 and 61. FIG. 32 is a top cross-sectional view showing the FIG. 31 holder FIG. 33 is an exploded perspective view showing the units mountable in a tool box.

To summarize some possible variations on the holders, they can be attached to each other in a variety of ways:

a. back-to-back such that drop-bins are accessible from either side;

b. side-by-side such that drop-bins are accessible from the same side;

c. holders can be molded and connected together via a living hinge. The holder, in this case, can be folded and secured back-to-back to provide access to the drop-bins from either side; or d. the holder can be swung open and be flat, in which case, all the drop bins are accessible from the same side.

Also, double-thickness holders can be molded that will accept drop-bins in either direction.

The holders can be fabricated in many shapes and configurations, having drop-bins of corresponding shapes:

a. a circular holder around which drop-bins are installed. The holder can be rotated to select a particular bin/contents;

b. the holder can be polygonal, inserted into a swivel base, and equipped with a turning knob at the top (to rotate holder);

c. the holder can have a common wall (with or without a handle) onto which drop-bins can be attached from either side using various means (mentioned previously).

Yet another variation is that the holder could have a common vertical center wall, with drop-bin units secured to either side thereof by any suitable means.

Figure 34:
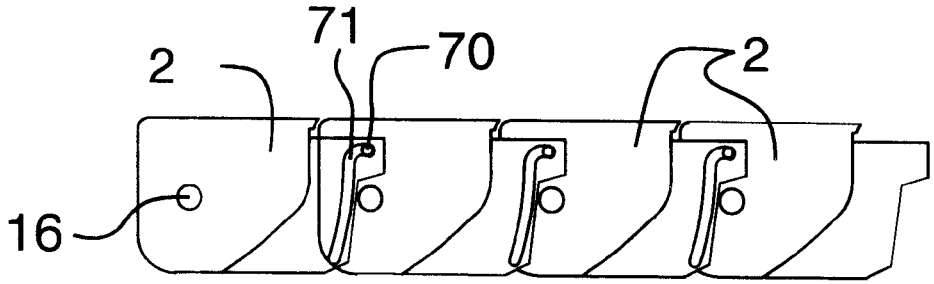
FIG. 34 is a side view showing an alternative means of ganging the bins, with the bins closed.
Figure 35:
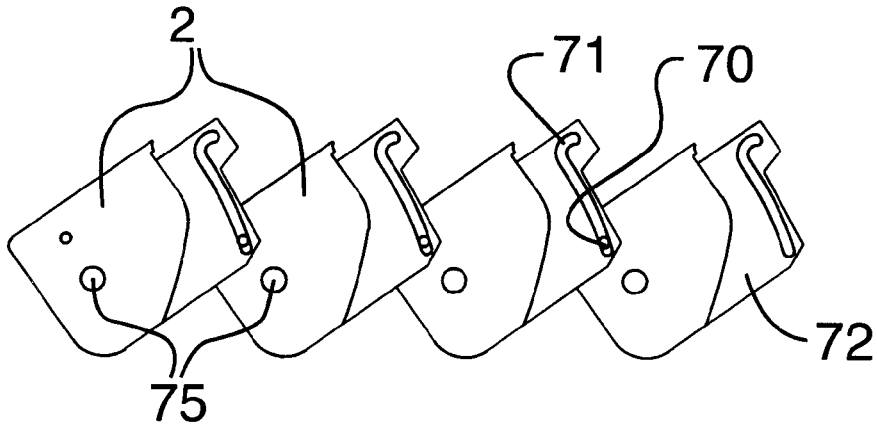
FIG. 35 is a side view showing the same alternative means of ganging the bins, with the bins open.

FIGS. 34 and 35 illustrate an alternative means of ganging the bins, i.e. instead of using gang bars. In this embodiment, the bins pivot on pins 75. Pins 70 from one bin ride in a slot 71 in a flange 72 attached to the side of the adjacent bin. By virtue of the geometry of the slot 71, rotating one bin 2 causes the wall of the slot to act on the pin of the adjacent bin, to cause that bin to rotate as well.

Figure 36:
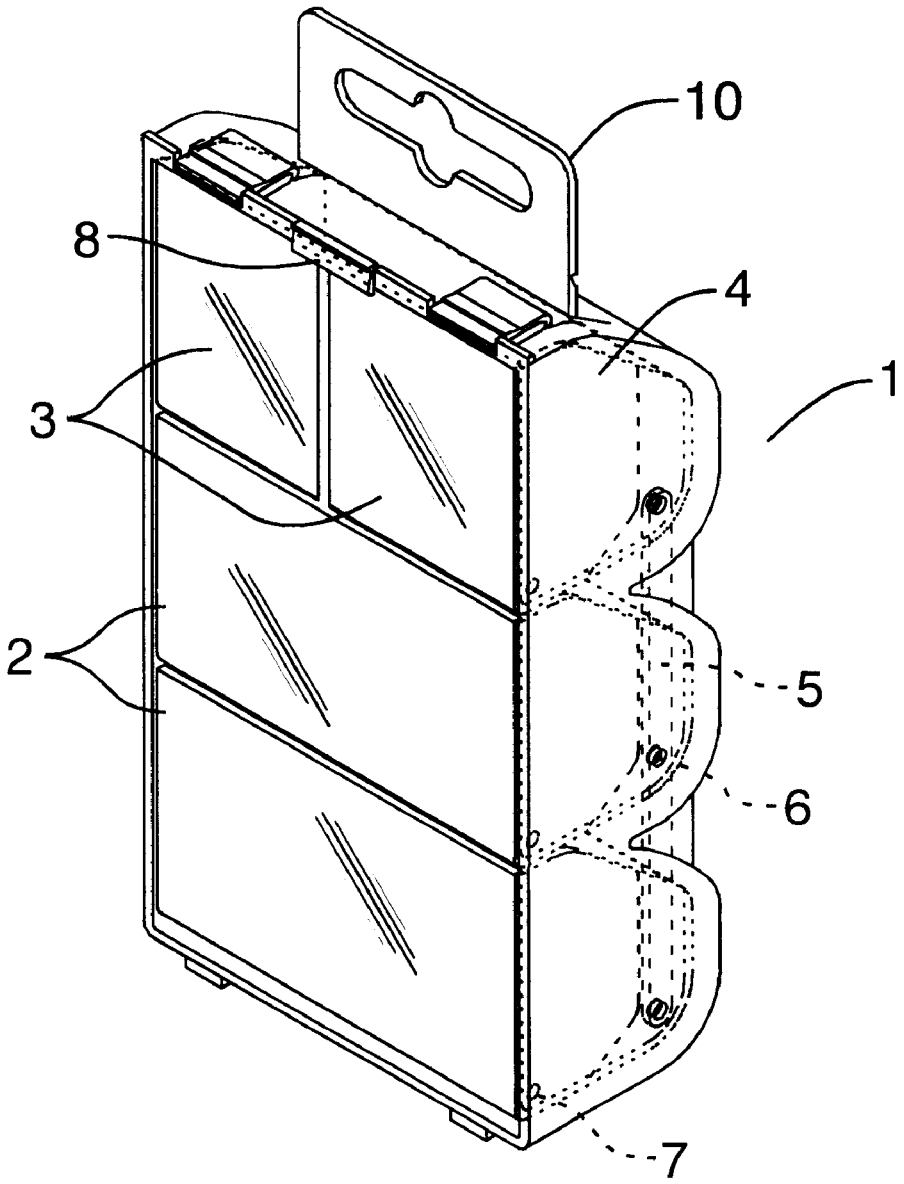
FIG. 36 is a perspective view corresponding to FIG. 2, showing an embodiment where the bins are not of uniform width.

A further variation is that the width of the bins could be varied or split. For example, as shown in FIG. 36, one or more of the bins could be split into two separate bins, one ganged from one side and the other ganged from the other side.

What is claimed is:

1. A container unit for small items, comprising a housing having opposing side walls, and a plurality of bins mounted between said side walls for rotation between closed and open positions, such that in said closed position, outer faces of said bins are generally coplanar, and in said open position, said outer faces each angle outwardly from said housing, thereby providing access into said bins, said bins being connected together for movement in unison, said outer faces occupying substantially all of a front portion of said housing, said bins being connected for movement in unison by gang means arranged along a side of said bins, connected to said bins, said housing having hanging means extending upwardly from an upper surface thereof, said hanging means having an opening for hanging said container unit, and said hanging means being foldable against said upper surface so as not to interfere with installation of said container unit in a holder.

2. A container unit cited in claim 1, wherein said housing comprises a readily-disengageable flexible clip to engage a said bin to hold said bins in said closed position, said housing further comprising retaining means configured to engage receiving means in said holder configured to receive at least one container unit.

3. A container unit as recited in claim 1, wherein said container has at least one tab at the bottom thereof, to insert into a corresponding slot in said holder, and at least one catch to engage a corresponding means in said holder.

* * * * *